US009833687B2

(12) United States Patent
Edelstein

(10) Patent No.: US 9,833,687 B2
(45) Date of Patent: Dec. 5, 2017

(54) FOOT-DECK-BASED VEHICLE WITH INCREASED POTENTIAL ENERGY FOR OLLIE-TYPE MANOEUVERS

(71) Applicant: Sketchpad, Inc., Deerfield, IL (US)

(72) Inventor: Benjamin Zachary Edelstein, Deerfield, IL (US)

(73) Assignee: SKETCHPAD, INC., Deerfield, IL (US)

( * ) Notice: Subject to any disclaimer, the term of this patent is extended or adjusted under 35 U.S.C. 154(b) by 0 days.

(21) Appl. No.: 14/948,231

(22) Filed: Nov. 20, 2015

(65) Prior Publication Data

US 2016/0236066 A1 Aug. 18, 2016

Related U.S. Application Data

(60) Provisional application No. 62/115,977, filed on Feb. 13, 2015.

(51) Int. Cl.

| | |
|---|---|
| ***A63C 17/26*** | (2006.01) |
| ***A63C 17/00*** | (2006.01) |
| ***A63C 17/01*** | (2006.01) |

(52) U.S. Cl.

CPC ..... *A63C 17/0046* (2013.01); *A63C 17/01* (2013.01); *A63C 17/015* (2013.01); *A63C 17/012* (2013.01); *A63C 2203/40* (2013.01); *A63C 2203/42* (2013.01)

(58) Field of Classification Search

CPC ... A63C 17/0046; A63C 17/01; A63C 17/017; A63C 17/26; A63C 2201/02; A63C 2203/20; A63C 2203/40; A63C 2203/42; F16F 1/041; F16F 1/145

See application file for complete search history.

(56) References Cited

U.S. PATENT DOCUMENTS 4,003,582 A * 1/1977 Maurer ..... A63C 17/01 188/2 R
4,120,508 A * 10/1978 Brown ..... A63C 17/0086 280/11.28
4,120,510 A * 10/1978 Hillard ..... A63C 17/01 280/11.28

(Continued)

OTHER PUBLICATIONS

EP 16153784, European Search Report, dated Jun. 17, 2016.

*Primary Examiner* — James A Shriver, II
*Assistant Examiner* — Steve Clemmons
(74) *Attorney, Agent, or Firm* — Millman IP Inc.

(57) ABSTRACT

In an aspect, a foot-deck based vehicle is provided, comprising a foot-deck, a front wheel arrangement, a rear wheel arrangement and a biasing member. The foot-deck has a front end and a rear end. The front wheel arrangement is proximate the front end. The rear wheel arrangement is proximate the rear end. The foot-deck has a first foot-deck portion and a second foot-deck portion that is rearward of the first foot-deck portion and that is movable relative to the first foot-deck portion. The second foot-deck portion extends rearward of the rear wheel arrangement. The biasing member biases the second foot-deck portion towards a home position relative to the first foot-deck portion. The second foot-deck portion is moveable from the home position downward to a biased position so as to store potential energy in the biasing member such that the biasing member urges the first foot-deck portion upward.

9 Claims, 4 Drawing Sheets

(56) References Cited

U.S. PATENT DOCUMENTS

| | | | | | |
|---|---|---|---|---|---|
| 4,123,080 | A * | 10/1978 | Agajanian | A63C 17/0046 | 280/220 |
| 4,155,565 | A * | 5/1979 | de Caussin | A63C 17/0046 | 280/11.19 |
| 4,168,076 | A * | 9/1979 | Johnson | A63C 17/01 | 188/5 |
| 4,195,857 | A * | 4/1980 | Hechinger | A63C 17/01 | 280/11.19 |
| 5,464,197 | A * | 11/1995 | Ecclesfield | F16F 1/041 | 267/155 |
| 5,540,455 | A * | 7/1996 | Chambers | A63C 5/035 | 280/11.28 |
| 5,983,936 | A * | 11/1999 | Schwieterman | F16F 1/041 | 137/615 |
| 6,145,857 | A * | 11/2000 | Bernstein | A63C 17/0006 | 280/11.208 |
| 7,931,519 | B2 * | 4/2011 | Fox | A63H 17/25 | 280/87.042 |
| 8,720,917 | B1 * | 5/2014 | Gair | A63C 17/26 | 280/11.27 |
| 2014/0103620 | A1 * | 4/2014 | Cornillon | A63B 25/10 | 280/611 |
| 2014/0312582 | A1 * | 10/2014 | Scolari | A63C 17/18 | 280/7.12 |
| 2015/0097352 | A1 * | 4/2015 | Ivazes | A63C 17/012 | 280/124.175 |

* cited by examiner

FOOT-DECK-BASED VEHICLE WITH INCREASED POTENTIAL ENERGY FOR OLLIE-TYPE MANOEUVERS

CROSS-REFERENCE TO RELATED APPLICATIONS

This application claims the benefit of U.S. Provisional Patent Application No. 62/115,977 filed Feb. 13, 2015, the contents of which are incorporated herein in their entirety.

FIELD

This disclosure relates generally to the art of foot-deck based vehicles and more particularly to skateboards.

BACKGROUND

In the art of skateboarding, many tricks that are performed incorporate some variant of an ollie-type manoeuver. The ollie is a manoeuver in which the rider leaps into the air with the skateboard, without the use of his/her hands to hold the skateboard. Generally speaking, the ollie is considered a relatively important trick to master for those who wish to perform advanced skateboarding manoeuvers, and is fundamental to many of those manoeuvers. It is also generally considered to be difficult to learn. An important aspect of learning to perform an ollie successfully is to be able to get the board high enough off the ground in order to pass over an obstacle. Getting increased height from the ground is beneficial in order to permit the rider to pass over relatively high obstacles. It also permits the rider to pass over relatively long obstacles, since increased height off the ground during a jump (i.e. during an ollie) can result in increased length of the jump. It is therefore beneficial to provide a skateboard or other foot-deck based vehicle that facilitates relatively higher ollies.

SUMMARY

In an aspect, a foot-deck based vehicle is provided, comprising a foot-deck, a front wheel arrangement, a rear wheel arrangement and at least one first biasing member. The foot-deck has a front end and a rear end. The front wheel arrangement is proximate the front end. The rear wheel arrangement is proximate the rear end. The foot-deck has a first foot-deck portion and a second foot-deck portion that is rearward of the first foot-deck portion and that is movable relative to the first loot-deck portion. The second foot-deck portion extends rearward of the rear wheel arrangement. The at least one first biasing member biases the second foot-deck portion towards a home position relative to the first foot-deck portion. The second foot-deck portion is moveable from the home position downward to a biased position so as to store potential energy in the at least one first biasing member such that the at least one first biasing member urges the first foot-deck portion upward.

BRIEF DESCRIPTION OF THE DRAWINGS

The foregoing and other aspects of the invention will be better appreciated with reference to the attached drawings, wherein.

DETAILED DESCRIPTION OF EXAMPLE EMBODIMENTS

Figure 1:
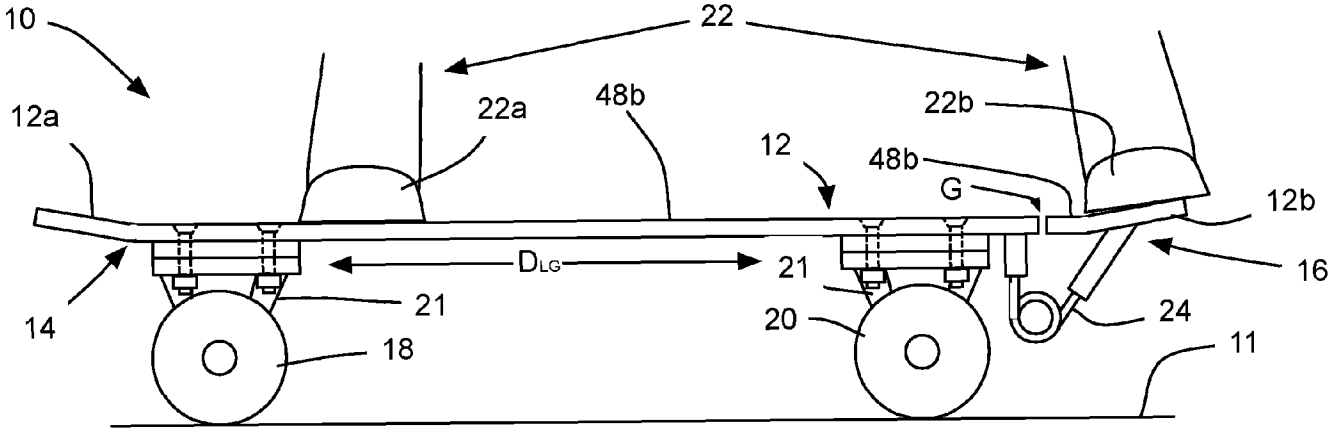
FIG. 1 is a side view of a foot-deck based vehicle, in a first position, in accordance with an embodiment of the disclosure.

FIG. 1 shows foot-deck-based vehicle 10 in accordance with an embodiment of the disclosure, on a ground surface 11. The foot-deck-based vehicle 10 shown in the figures is a skateboard, however, it will be understood that any other suitable type of foot-deck-based vehicle may be provided, such as, for example, a kick scooter.

The foot-deck-based vehicle 10 may, for convenience, be referred to herein as a skateboard 10. However, it is to be understood that it could be any other suitable foot-deck-based vehicle.

The skateboard 10 includes a foot-deck 12 that is elongate and has a front end 14 and a rear end 16, and which defines a longitudinal direction $D_{LG}$ for the skateboard 10. The skateboard 10 further includes a front wheel arrangement 18 proximate the front end 12, and a rear wheel arrangement 20 proximate the rear end 14. The front and rear wheel arrangements 18 and 20 may be mounted to the foot-deck 12 in any suitable manner known in the art, such as by suitable first and second trucks 21 so as to permit a lean-to-steer functionality for the skateboard.

Figure 2:
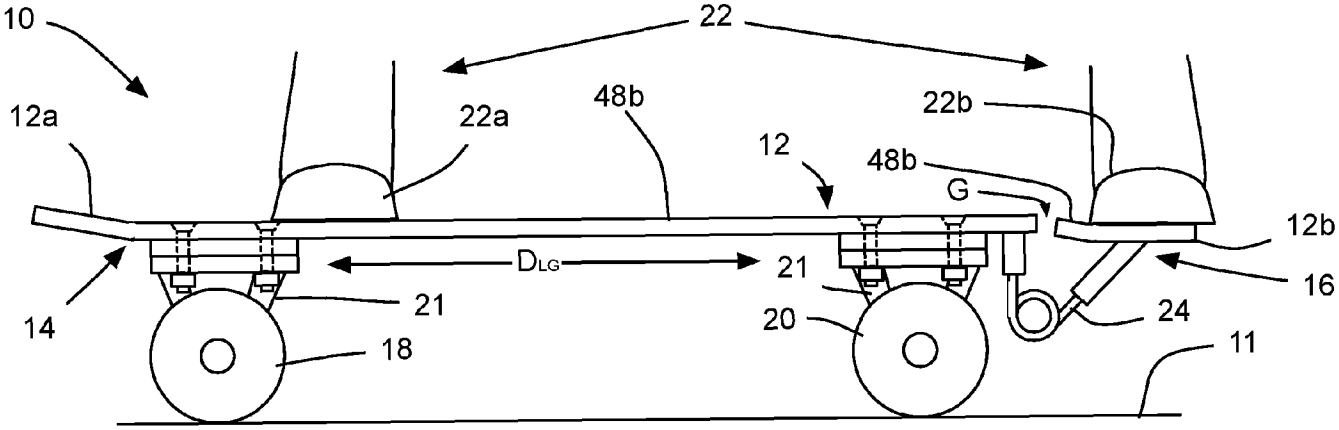
FIG. 2 is a side view of the foot-deck based vehicle shown in FIG. 1, in a second position.

The foot-deck 12 has a first foot-deck portion 12*a* and a second foot-deck portion 12*b* that is rearward of the first foot-deck portion 12*a* and that is movable relative to the first foot-deck portion 12*a*. As can be seen in FIG. 1, the second foot-deck portion 12*b* extends rearward of the rear wheel arrangement 20. For greater clarity, it is not necessary for the entirety of the second foot-deck portion 12*b* to be rearward of the rear wheel arrangement 20. It is only necessary that some portion of the second foot-deck portion 12*b* be positioned rearward of the rear wheel arrangement 20 in order to permit a rider 22 to press down on it so as to initiate an ollie-type manoeuvre, as described further below. A portion of the rider 22 (namely, the feet and lower portions of the legs) is shown at in FIGS. 1 and 2.

The skateboard 10 further includes at least one first biasing member 24 that biases the second foot-deck portion 12*b* towards a home position (FIG. 1) relative to the first foot-deck portion 12*a*. The second foot-deck portion 12*b* is moveable from the home position downward to a biased position (FIG. 2) so as to store potential energy in the biasing member 24 such that the at least one first biasing member 24 urges the first foot-deck portion 12*a* upward.

In the example shown, the at least one first biasing member 24 includes first and second first biasing members 24*a* and 24*b* (FIG. 3) that are spaced laterally from one another and that together make up a biasing arrangement 26. Each first biasing member 24 is, in the example shown, a torsion spring and has a first end 25*a* that is releasably connectable to the first foot-deck portion 12*a* and a second end 25*b* that is releasably connectable to the second foot-deck portion 12*b*. In the example shown, the first end 25*a* is a first tang that is generally snugly received in a first end receiving aperture 26 in a first tube 28 that forms part of the first foot-deck portion 12*a*. A plurality of first end set screws 29 (FIG. 4) pass through the wall of the first tube 28 and capture the first end 25*a* locking it in the first end receiving aperture 26. Similarly, the second end 25*b* is a second tang that is generally snugly received in a second end receiving aperture 30 in a second tube 32 that forms part of the second foot-deck portion 12*b*. A plurality of second end set screws 33 pass through the wall of the second tube 32 and capture the second end 25*b*, locking it in the second end receiving aperture 30.

Figure 3:
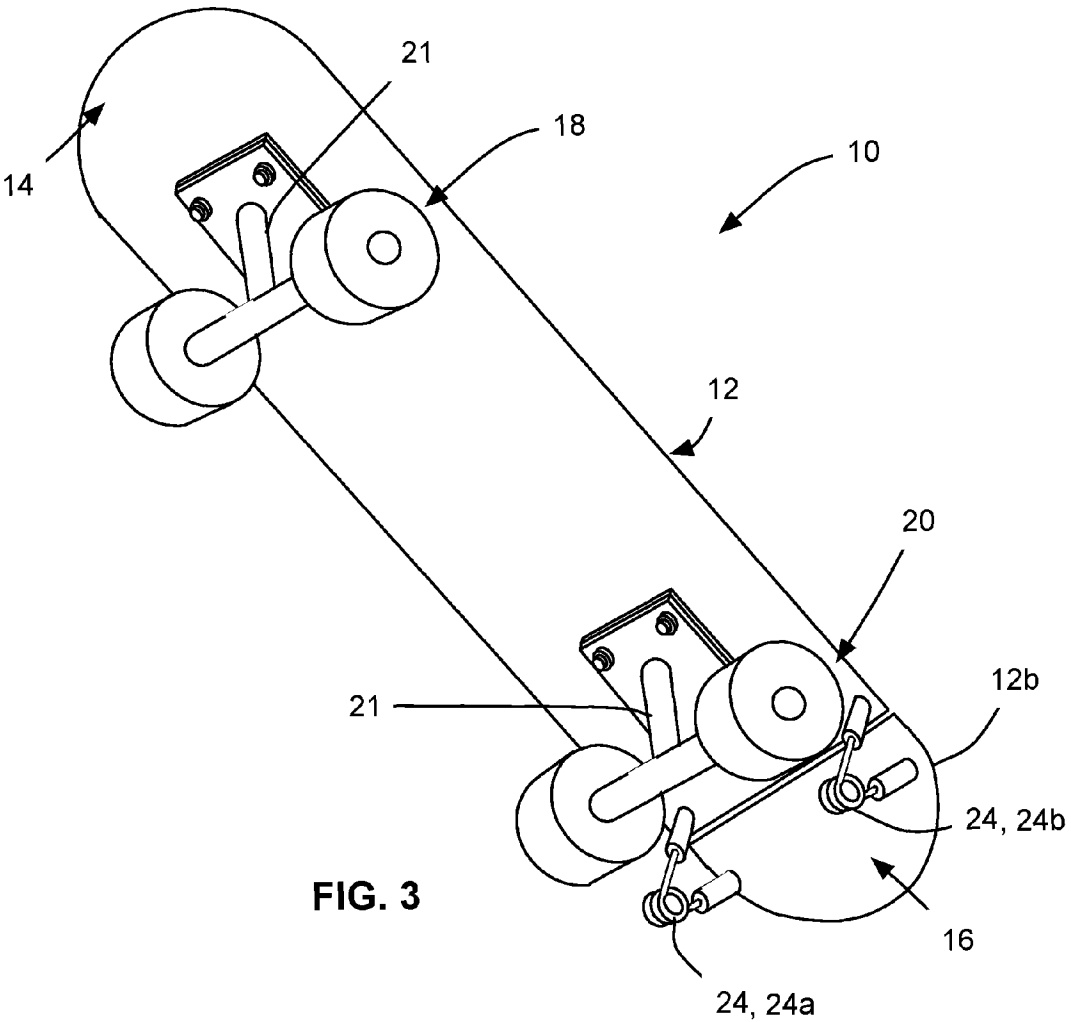
FIG. 3 is a perspective view from underneath the foot-deck based vehicle shown in FIG. 1.
Figure 4:
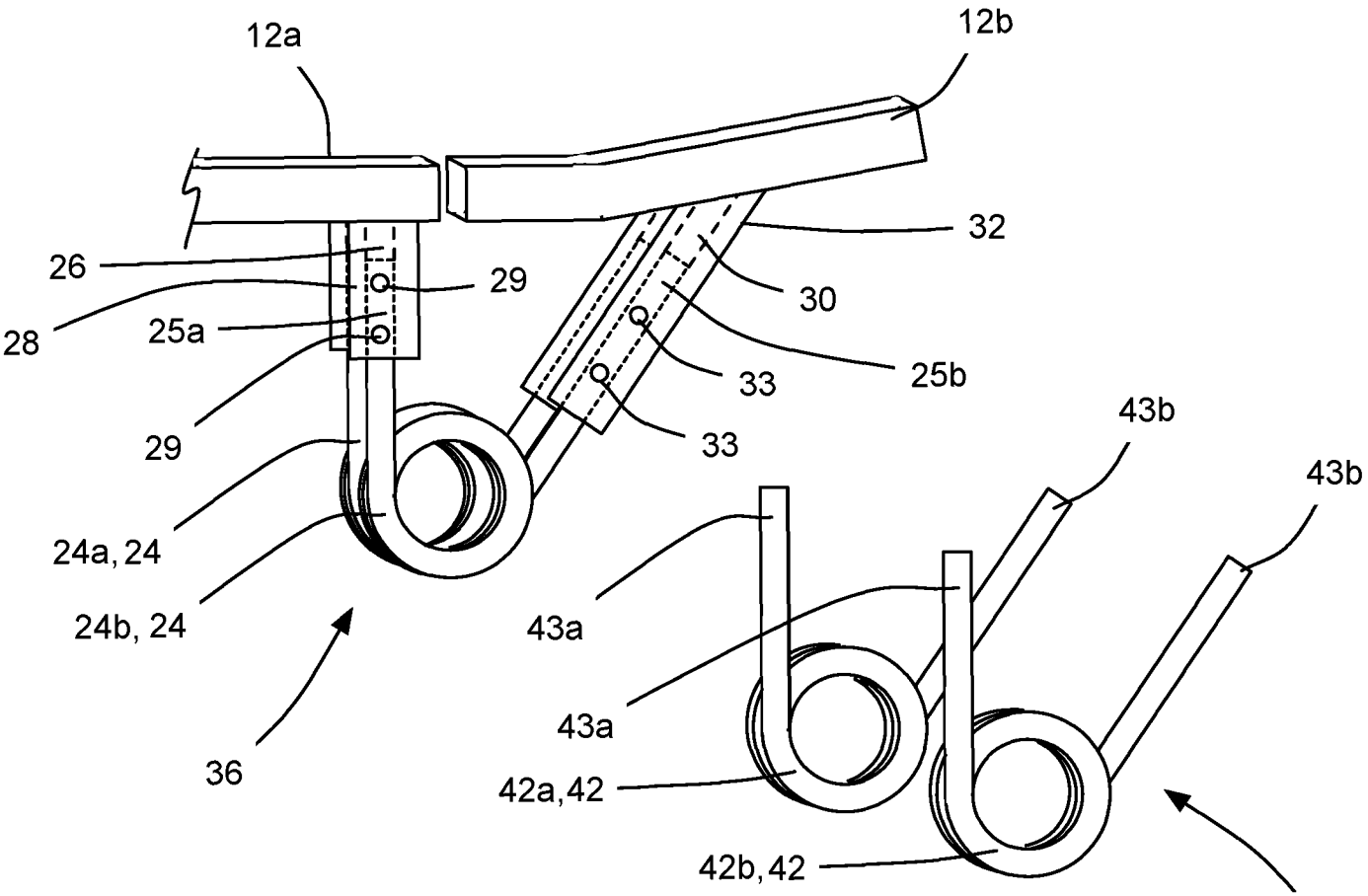
FIG. 4 is a side perspective view showing a plurality of first biasing members that may be part of the foot-deck based vehicle in FIG. 1, and a plurality of second biasing members that optionally are also included with the foot-deck based vehicle shown in FIG. 1.

It will be noted that, in FIG. 4, the second foot-deck portion 12*b* is shown as having the feature of being generally square at its rear end instead of having a rounded rear end as shown in FIG. 3. Either configuration is contemplated.

As can be seen in FIG. 3, in the example shown the biasing member 24 is part of a biasing arrangement 36 that includes two of the biasing member (i.e. first and second ones of the biasing member 24) that each apply a biasing force between the first and second foot-deck portions 12*a* and 12*b*. The biasing forces applied by the biasing members in the biasing arrangement may all be the same, or alternatively they may be different for each biasing member. In FIG. 3, the two ones of the biasing member are shown at 24*a* and 24*b* respectively. While two of the biasing member are shown in FIG. 3, it will be understood that the biasing arrangement could alternatively have three or more ones of the biasing member 24. In embodiments where more than one of the biasing member 24 is provided in the biasing arrangement, the biasing members 24 making up the biasing arrangement may all the substantially identical (as shown in FIG. 3), or alternatively they may be different from one another.

With reference to FIG. 4, the at least one first biasing member 24 (e.g. the first and second first biasing members 24*a* and 24*b*) has a first spring rate associated therewith. In some embodiments, the skateboard 10 further includes at least one second biasing member 42. In the example shown in FIG. 4, there are first and second, second biasing members shown at 42*a* and 42*b* respectively. Each of the second biasing members 42 has a first end 43*a* that is releasably connectable to the first foot-deck portion 12*a* and a second end 43*b* that is releasably connectable to the second foot-deck portion 12*b*. The at least one second biasing member 42 has a second spring rate that is different from the first spring rate. The at least one first biasing member 24 is removable from the first and second foot-deck portions 12*a* and 12*b* and is replaceable with the at least one second biasing member 42.

The second spring rate may, for example, be selected to be lower than the first spring rate, such that the at least one first biasing member 24 may be usable by a first person who is relatively heavier, and the at least one second biasing member 42 may be usable by a second person who is relatively lighter, thereby making the skateboard 10 usable by riders covering a range of different weights.

The at least one second biasing member 42 may be dimensionally similar to the at least one first biasing member 24, but may be made from a different material so as to have a different spring rate. Alternatively, the at least one second biasing member 42 may be dimensionally different than the at least one first biasing member 24, and may thus be made from thicker or thinner material than the at least one first biasing member 24, but the first and second ends 43*a* and 43*b* may be similar dimensionally to the first and second ends 25*a* and 25*b* so that they all fit similarly to one another in the receiving apertures 26 and 30.

While first and second biasing members 24 and 42 are shown in the example embodiment in FIG. 4, it will be understood that it is possible for the skateboard 10 to only include at least one first biasing member 24.

In the embodiment shown in FIGS. 1-4, it can be seen that the second foot-deck portion 12*b* is spaced from the first foot-deck portion 12*a* and is connected to the first foot-deck portion 12*a* only through the at least one biasing member 24 (or 42). For example, a longitudinal gap (G) is shown on the foot-deck riding surface (i.e. the surface of the foot-deck that supports the rider 22), between a first portion 48*a* and a second portion 48*b* (on the first and second foot-deck portions respectively 12*a* and 12*b*).

Alternatively, however, the second foot-deck portion 12*b* may be connected to the first foot-deck portion 12*a* via a suitable type of connection that permits the second foot-deck portion to travel between the home and biased positions as needed based on the force applied by the rider 22.

Figure 5:
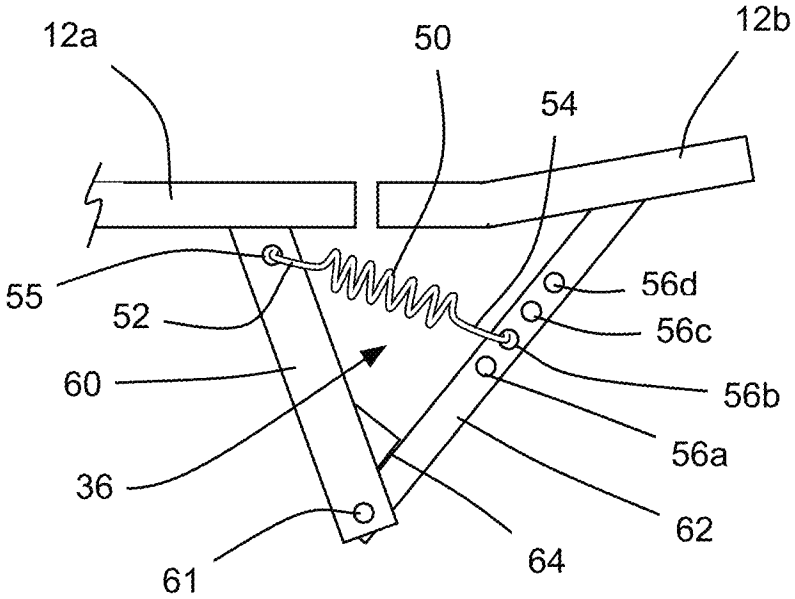
FIG. 5 is a side view of an alternative biasing arrangement to that which is shown in FIGS. 1-4.

With reference to FIG. 5, another optional feature of the connection between the at least one first biasing member 24 and the first and second foot-deck portions 12*a* and 12*b*, is for the at least one first biasing member 24 to be adjustably connected to the foot-deck 12 in a plurality of positions, so as to adjust a force-deflection relationship for the second foot-deck portion 12*b*. This feature may be achieved in any suitable way. For example, in the embodiment shown in FIG. 5, the at least one first biasing member includes at least one first helical tension spring 50. Each of the first and second ends (shown at 52 and 54 respectively) of the tension spring 50 may include a hook, which are releasably received in first and second end receiving apertures 55 and 56 on the first and second foot-deck portions 12*a* and 12*b* respectively. On the second foot-deck portion 12*b* there are a plurality of end receiving apertures 56 (shown individually at 56*a*, 56*b*, 56*c* and 56*d*). As can be seen, the spring 50 will be stretched to a different length and will therefore have a different amount of preload in it depending on which of the apertures 56*a*-56*d* that its second end 54 is hooked into. Thus, when the spring 50 is in the aperture 56*d*, the preload in the spring 50 will be higher and so the spring force urging the second foot-deck portion 12*b* to remain at the home position (shown in FIG. 5) will be higher, than when the spring 50 is in the aperture 56*a*, for example. As a result, the aperture 56*d* may be used for instances when the rider 22 (FIG. 1) is relatively heavier and the aperture 56*a* may be used for instances when the rider 22 is relatively lighter.

It will be noted that, in the embodiment shown in FIG. 5, the second foot-deck portion is connected hingedly to the first foot-deck portion 12*a* by means of a first arm 60 on the first foot-deck portion 12*a* that is connected by a pin joint 61 to a second arm 62 on the second foot-deck portion 12*b*, while the spring 50 extends between the first and second arms 60 and 62. While a single first arm 60 and a single second arm 62 may be provided, it is preferable that a first arm 60 is provided on each of the left and right sides of the first foot-deck portion 12*a* and a second arm 62 is provided at each of the left and right sides of the second foot-deck portion 12*b*. Providing two such first arms 60 and two such second arms 62 pivotally connected to the first arms 60 renders the connection between the first and second foot-deck portions 12*a* and 12*b* more resistant to twisting deformation and better constrains the movement of the second foot-deck portion 12*b* relative to the first foot-deck portion 12*a* to be in the vertical and longitudinal directions and not in the lateral direction.

In all the positions for the spring 50 (i.e. regardless of which hole 56 the second end 54 of the spring 50 is in), there is some tension in the spring 50 and the spring 50 holds the second arm 62 in abutment with a limit surface 64 on the first arm 60. This defines the home position for the second foot-deck portion 12*b*.

Constraint of the second foot-deck portion 12*b* from lateral movement relative to the first foot-deck portion 12*a* in the embodiment shown in FIGS. 1-4 may be achieved through the stiffness of the torsion springs 24 or 42 themselves.

It is optionally possible for the at least one biasing member 24 (or 42, or 50) to include a single biasing member. In such an embodiment, the biasing member 24, or 42, or 50 may be positioned generally along the longitudinal centerline of the skateboard 10. Preferably, the second foot-deck portion 12*b* would, in all embodiments, be constrained sufficiently to substantially prevent substantially any lateral movement relative to the first foot-deck portion 12*a* during movement of the second foot-deck portion 12*b* between the home and biased positions. Thus, for example, the pin joints 61 between the first and second arms 60 and 62 may prevent any lateral play.

The rider 22 performs an ollie-type manoeuvre substantially as they would with a traditional skateboard. The rider 22 has a first foot 22*a* on the first foot-deck portion 12*a* and a second foot 22*b* on the second foot-deck portion 12*b*. When the rider 22 pushes down with the second foot 22*b* on the second foot-deck portion 12*b* to bring the second foot-deck portion 12*b* away from the home position to a biased position (FIG. 2), while maintaining a portion of their weight on the first foot-deck portion 12*a* with their first foot 22*a*, potential energy is stored in the at least one biasing member 24 (or 42, or 50), such that the at least one biasing member 24, 42 or 50 urges the first foot-deck portion 12*a* upward. The rider 22 jumps using the known technique for performing an ollie. Upon release of the rider's first foot 22*a* from the first foot-deck portion 12*a*, the at least one biasing member 24, 42 or 50 releases its stored potential energy and drives the first foot-deck portion 12*a* upwards with greater energy than can be had with a similar skateboard that does not include the at least one biasing member 24, 42 or 50. This facilitates achieving a greater height above the ground surface 11 for the ollie-type manoeuvre.

While the description contained herein constitutes a plurality of embodiments of the present invention, it will be appreciated that the present invention is susceptible to further modification and change without departing from the fair meaning of the accompanying claims.

The invention claimed is:

1. A foot-deck based vehicle, comprising a foot-deck having a front end and a rear end, a front wheel arrangement proximate the front end, and a rear wheel arrangement proximate the rear end, wherein the foot-deck has a first foot-deck portion and a second foot-deck portion that is rearward of the first foot-deck portion and that is movable relative to the first foot-deck portion, wherein the second foot-deck portion extends rearward of the rear wheel arrangement; and at least one first biasing member that is adjustably connected to the foot-deck in one of a plurality of discrete positions so as to adjust a force-deflection relationship biasing the second foot-deck portion towards a home position relative to the first foot-deck portion, wherein the second foot-deck portion is moveable from the home position downward to a biased position so as to store potential energy in the at least one first biasing member such that the at least one first biasing member urges the first foot-deck portion upward.

2. A foot-deck based vehicle as claimed in claim 1, wherein each first biasing member has a first end that is releasably connectable to the first foot-deck portion and a second end that is releasably connectable to the second foot-deck portion.

3. A foot-deck based vehicle as claimed in claim 2, wherein the at least one first biasing member has a first spring rate and wherein the foot-deck based vehicle further comprises at least one second biasing member, each of which has a first end that is releasably connectable to the first foot-deck portion and a second end that is releasably connectable to the second foot-deck portion, and wherein the at least one second biasing member has a second spring rate that is different from the first spring rate, wherein the at least one first biasing member is removable from the first and second foot-deck portions and is replaceable with the at least one second biasing member.

4. A foot-deck based vehicle as claimed in claim 1, wherein the at least one biasing member includes a torsion spring.

5. A foot-deck based vehicle as claimed in claim 1, wherein the at least one biasing member includes first and second first biasing members, wherein the first and second first biasing members are spaced apart laterally from one another.

6. A foot-deck based vehicle as claimed in claim 1, wherein the second foot-deck portion is spaced from the first foot-deck portion in at least one of the home position and the biased position.

7. A foot-deck based vehicle as claimed in claim 1, wherein the second foot-deck portion is spaced from the first foot deck portion in both the home position and the biased position.

8. A foot-deck based vehicle as claimed in claim 1, wherein the second foot-deck portion is connected to the first foot-deck portion only through the biasing member.

9. A foot-deck based vehicle as claimed in claim 1, wherein the foot-deck based vehicle is a skateboard.

* * * * *